US007005788B2

(12) United States Patent
Azzi et al.

(10) Patent No.: US 7,005,788 B2
(45) Date of Patent: Feb. 28, 2006

(54) MAGNETIC DEVICE FOR CORRECTING IMAGE GEOMETRY DEFECTS FOR CATHODE-RAY TUBES

(75) Inventors: Nacerdine Azzi, Fontaine-les-Dijon (FR); Céline Cossu, Saint Apollinaire (FR); Sébastien Volatier, Dijon (FR)

(73) Assignee: Thomson Licensing, Boulogne-Billancourt (FR)

( * ) Notice: Subject to any disclaimer, the term of this patent is extended or adjusted under 35 U.S.C. 154(b) by 255 days.

(21) Appl. No.: 10/397,755

(22) Filed: Mar. 26, 2003

(65) Prior Publication Data

US 2003/0184208 A1 Oct. 2, 2003

(30) Foreign Application Priority Data

Mar. 27, 2002 (FR) ..... 02 03839

(51) Int. Cl.
*H01J 29/70* (2006.01)

(52) U.S. Cl. ..... 313/440; 335/210

(58) Field of Classification Search ..... 313/440; 335/213, 210, 296

See application file for complete search history.

(56) References Cited

FOREIGN PATENT DOCUMENTS

| | | |
|---|---|---|
| EP | 0613168 A1 | 8/1994 |
| FR | 2766612 | 7/1997 |
| FR | 0203839 | 12/2002 |

*Primary Examiner*—Ashok Patel
(74) *Attorney, Agent, or Firm*—Joseph S. Tripoli; Harvey D. Fried; Patricia A. Verlangieri

(57) ABSTRACT

Deflection yoke for cathode-ray tubes with a north/south geometry correction comprising a pair of horizontal deflection coils and a pair of vertical deflection coils, the two pairs being isolated one from the other by a separator, a ferrite ring at least partly covering the deflection coils and having a flared front part, the deflection yoke comprising in its front region at least one pair of magnetic means to modify locally the magnetic field in the said front region and to correct the geometry of the image created on the screen of the tube, the magnetic means being placed in the space in such a way that, for a plane containing the longitudinal axis of the deflection yoke and the axis of symmetry of a magnetic means, and for the point M of the plain corresponding to the point of minimum coordinates of the said means, the intersection of the ring with is at least partly in its front part, located outside the region delimited by the half line passing through M and perpendicular to Z, and the half line passing through M and making an angle of 45° with.

7 Claims, 7 Drawing Sheets

MAGNETIC DEVICE FOR CORRECTING IMAGE GEOMETRY DEFECTS FOR CATHODE-RAY TUBES

This application claims the benefit under 35 U.S.C. §365 of French patent application No. 0203839 filed Mar. 27, 2002.

BACKGROUND OF THE INVENTION

The present invention relates to a magnetic device for correcting geometrical defects in the image created on the screen of a cathode-ray tube and is more particularly suited to tubes whose front face has a high radius of curvature.

A cathode-ray tube designed to generate colour images generally comprises an electron gun emitting three electron beams, each beam being designed to excite a luminescent material of a particular primary colour (red, green or blue) on the screen of the tube.

The electron beams scan the tube's screen under the influence of the deflection fields created by a deflection device, also called deflection yoke, fastened to the neck of the tube, comprising horizontal and vertical coils for deflecting the said beams. A substantially frustoconical-shaped ring, made of a ferromagnetic material, conventionally surrounds the deflection coils so as to concentrate the deflection fields in the appropriate region.

The three beams generated by the electron gun must always converge on the tube's screen or else suffer in the introduction of an error called a convergence error which, in particular, distorts the rendition of the colours. In order to achieve convergence of the three coplanar beams, it is known to use fields called self-converging astigmatic deflection fields; in a self-converging deflection coil, the lines of flux caused by the horizontal deflection winding are generally in the form of a pincushion in a portion of the coil which lies more to the front of the latter on the side of the screen of the tube. This amounts to introducing, into the distribution of the turns making up the line coil, a highly positive 3rd harmonic of the ampere-turns density at the front of the coil.

Moreover, due to the action of uniform horizontal and vertical magnetic deflection fields, the volume scanned by the electron beams is a pyramid, the apex of which is coincident with the centre of deflection of the deflection yoke and the intersection of which with a non-spherical screen surface exhibits a geometrical defect called pincushion distortion. This geometrical distortion of the image is all the greater the larger the radius of curvature of the screen of the tube. Self-converging deflection yokes generate astigmatic deflection fields making it possible to modify the north/south and east west geometry of the image and, in particular compensate for the north/south pincushion distortion. The east/west geometrical defects are generally corrected by an electronic circuit associated with the deflection yoke.

However, the current trend which is developing towards tubes having an increasingly flat, or even a completely flat screen surface particularly amplifies the image geometry problems; the result of this is that the self-convergent deflection yokes can no longer completely provide the geometrical correction for the north/south pincushion, while moreover, the east/west geometrical defects require increasingly strong corrections.

To correct these pincushion-shaped distortions of the image, linked to the flatness of the screen and to the self-convergent deflection device equipping the tube, it is known to use magnetic correction means in the form either of permanent magnets or of magnetic coils powered by a constant or variable current.

These magnetic correction means are generally borne by the front ring of the separator, and therefore located above the front bundle of the deflection coils. However, these solution have to generate increasingly strong correction fields and then lead to residual distortions such as image symmetry defects or else register defects which affect the purity of the colours on the screen.

SUMMARY OF THE INVENTION

The object of the invention is to provide a solution to the image geometry defect without moreover producing residual defects which are difficult to correct.

To do this, the subject of the invention is a deflection yoke for a cathode-ray tube comprising a pair of horizontal deflection coils and a pair of vertical deflection coil, the two pairs being isolated one from the other by a separator, a ferrite ring at least partly covering the deflection coils and having a flared front part, the deflection yoke comprising, in its front region, at least one pair of magnetic means to modify locally the magnetic field in the said front region, characterized in that the magnetic means are arranged in the space such that, for a plane (P) containing the longitudinal axis (Z) of the deflection yoke and the axis of symmetry (Y) of a magnetic means, and for the point M of the plane (P) corresponding to the point the values of whose coordinates My and M, along the Y and Z axes are the minimum values of the coordinates along these same axes of the points of intersection of the said means with the plane (P), the intersection of the ring with (P) is at least partly in its front part, located outside the region delimited by the half line (D1) passing through M and perpendicular to Z. and the half line (D2) passing through M and making an angle of 45° with (D1).

BRIEF DESCRIPTION OF THE DRAWINGS

The invention and its various advantages will be better understood using the description below and the drawings, among which.

DETAILED DESCRIPTION OF THE PREFERRED EMBODIMENTS

Figure 1:
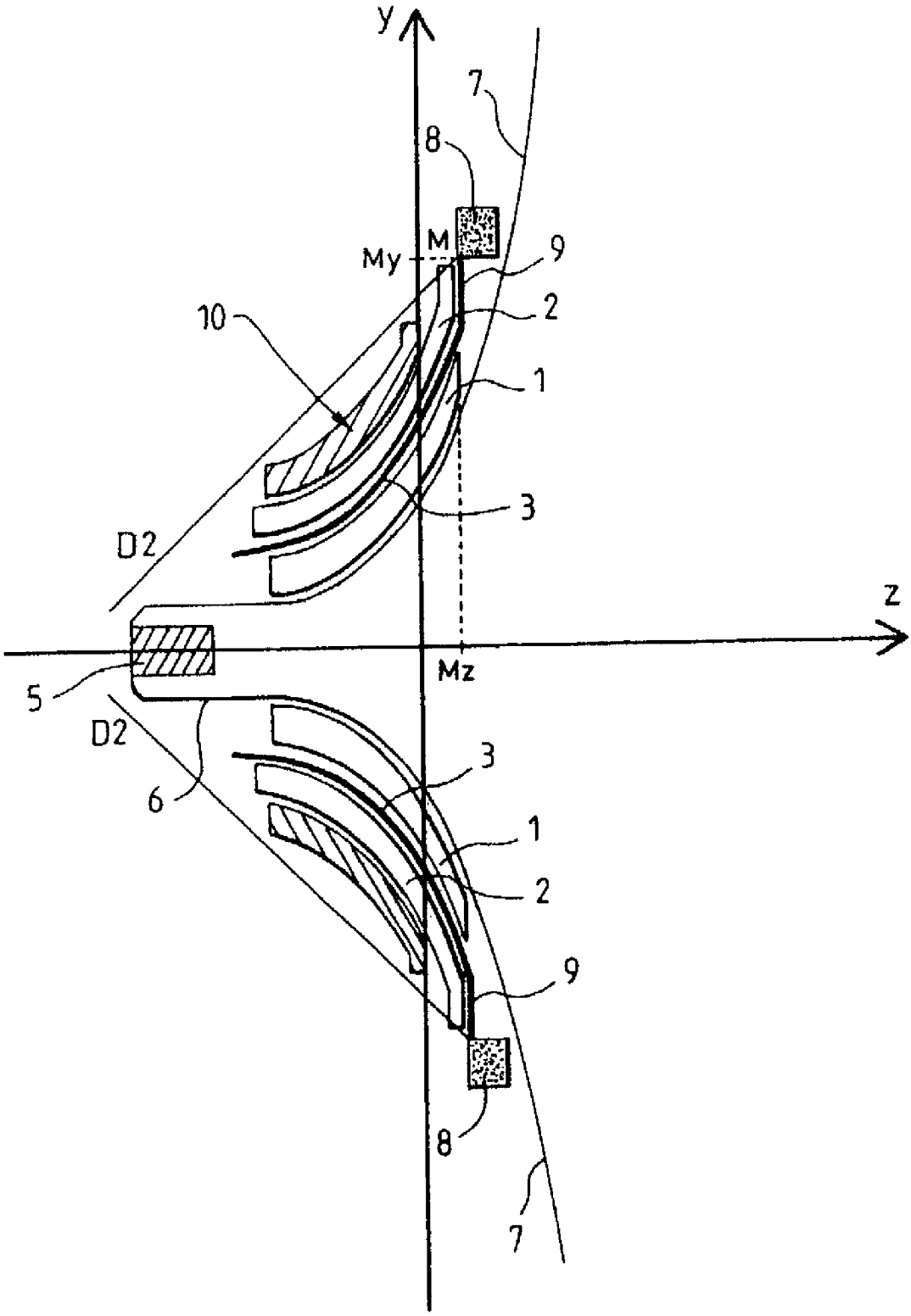
FIG. 1 shows in section a deflection yoke according to the prior art placed on the neck of a cathode-ray tube.

FIG. 1 illustrates, in a sectional view, a deflection yoke fitted to the neck of a cathode-ray tube.

The deflection yoke comprises a pair of horizontal deflection coils 1 and a pair of vertical deflection coils 2 isolated from each other by a separator 3 generally made of an electrically insulating plastic.

A ring 10 of substantially frustoconical shape is placed on the deflection coils in order to concentrate the deflection fields on the electron beams coming from an electron gun 5 placed on the neck 6 of the cathode-ray tube, a neck of substantially cylindrical shape.

The deflection coils 1 are placed on the flared part 7 of the tube. The separator 3 generally comprises a front ring 9 in particular bearing correction magnets 8 mainly designed to correct the geometrical defects which it has not been possible to correct by the astigmatism of the deflection fields. The magnets 8 generally have, as a plane of symmetry, the plane P containing the vertical deflection axis Y and the longitudinal axis Z, which is the main axis of the tube.

The intersection of the magnet with the plane P defines a cross section S contained in the said plane and the point M defined as the point, the values of whose coordinates $M_y$ and $M_z$ in the plane P are the minimum value $M_z$ of the points S.

Figure 2:
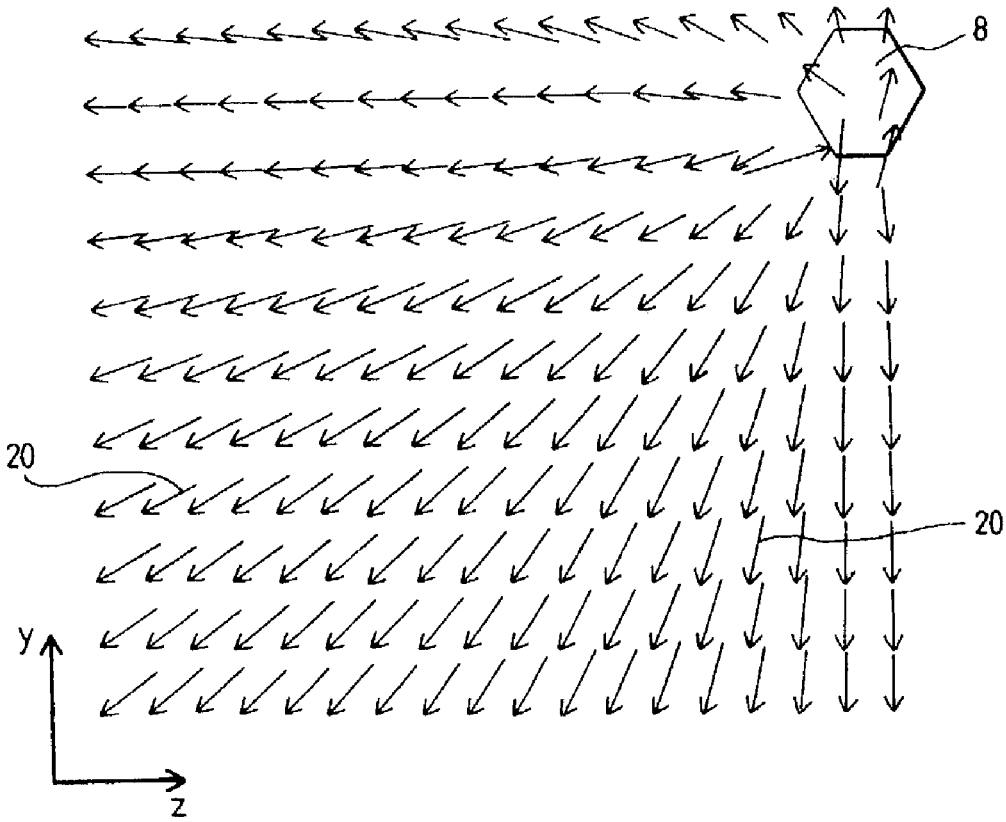
FIG. 2 shows the magnetic field lines created by a permanent magnet in a plane perpendicular to the said magnet.
Figure 3:
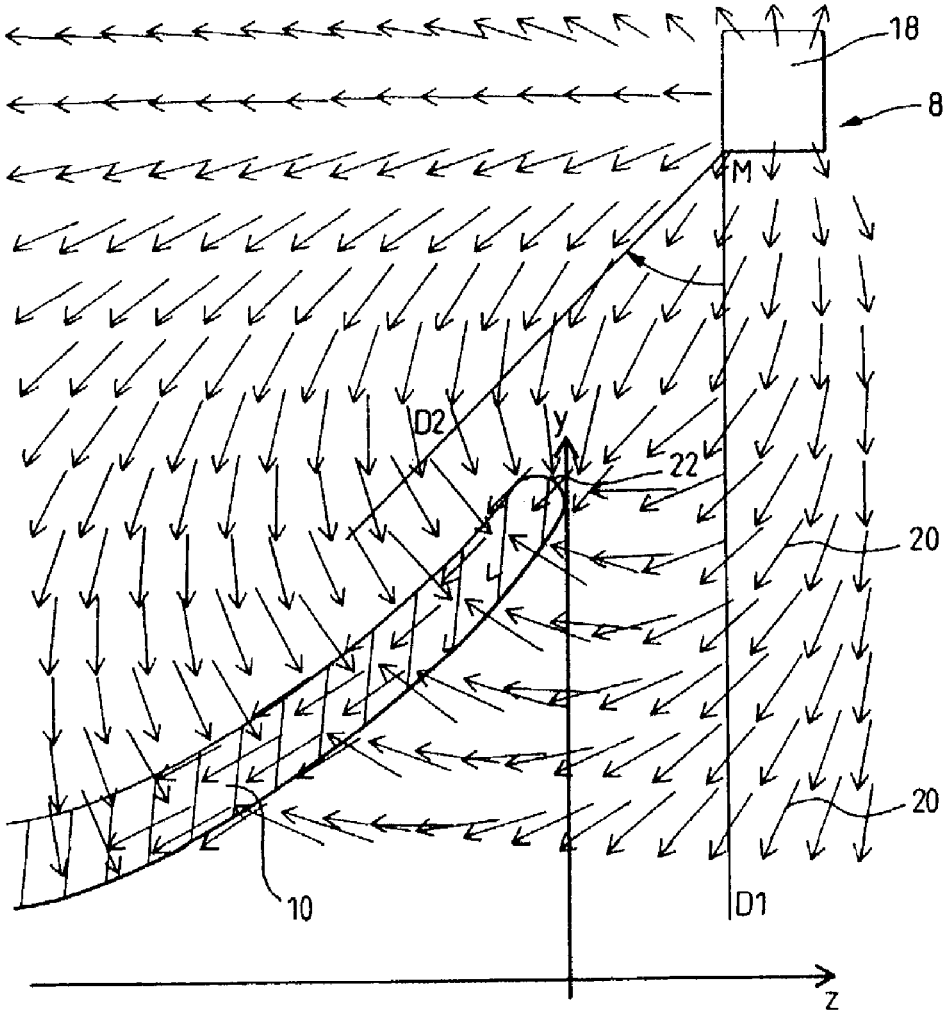
FIG. 3 shows the magnetic field lines created by a permanent magnet placed to the front of a deflection yoke in a configuration according to the prior art and in a plane perpendicular to the said magnet.
Figure 6:
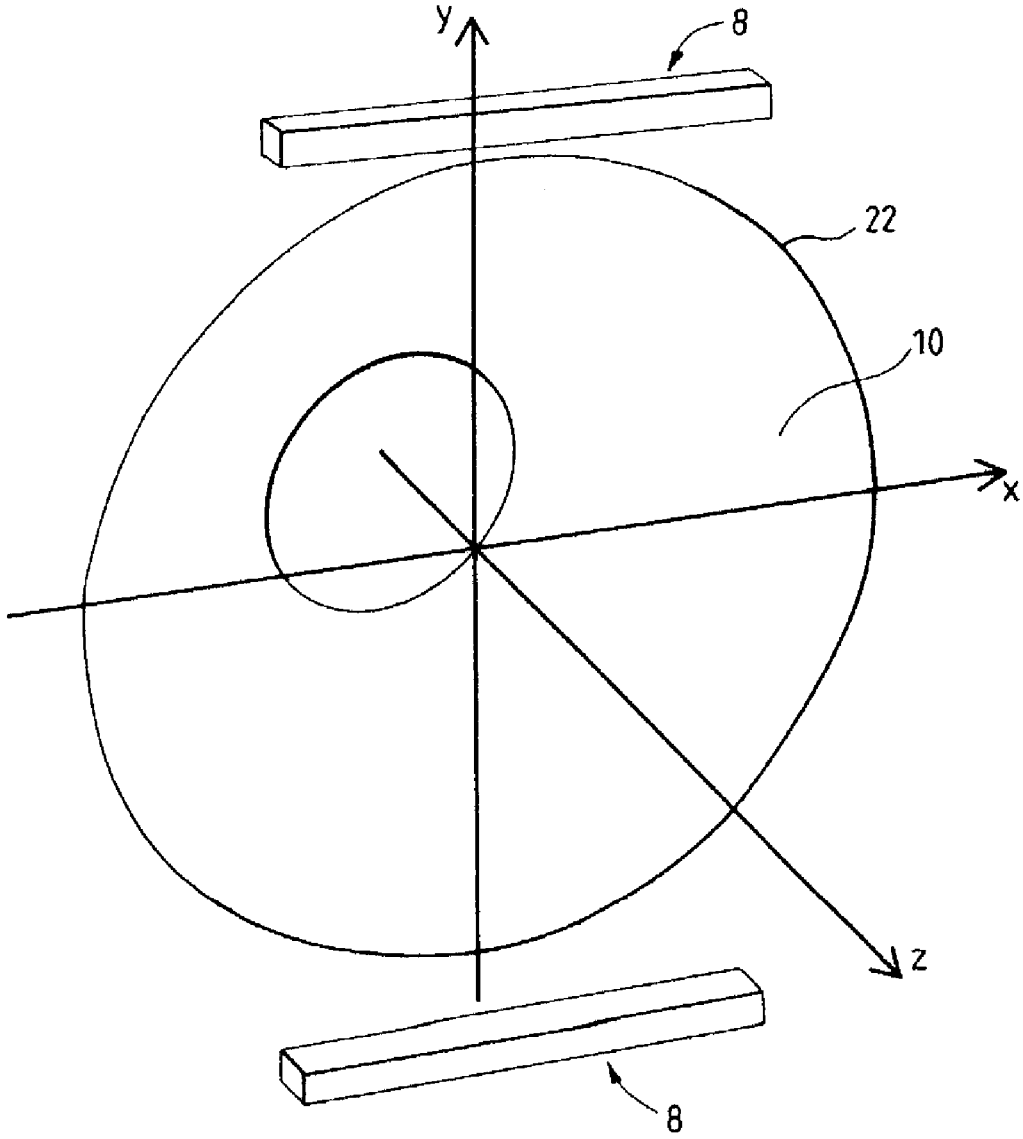
FIG. 6 illustrates, in a perspective view, the arrangement according to the invention of a pair of magnets with respect to the ferrite ring of the deflection yoke.

As illustrated in FIG. 6, the correction magnet 8 is, for example, in the form of a parallelepipedal barrel, lying mainly in the horizontal direction, symmetrically with respect to the plane YZ. FIG. 2 shows, in a section along this plane, the magnetic field vectors 20 created at different points of the plane by the said magnet 8, in the absence of the magnetic field vectors 20 in the presence of a ferromagnetic ring 10, placed with respect to the magnet in the configuration of the prior art. In the plane YZ, where Y is the vertical line against which the front of the ring 10 leans, the intersection of the magnet 8 with the said plane defines a surface 18. Each point of this surface is identified by its coordinates along the y and Z axes. The point M is defined as a point of the YZ plane, the values of the coordinates $M_y$ and $M_z$ of which, along the Y and Z axes, are the minimum values of the coordinates of the points of the surface 18 along the same axes. FIG. 3 shows the half line D1 coming from M, perpendicular to Z and the half line D2 such that the angle (D2,D1) is equal to 45° in the trigonometric sense. Thus the front 22 of the ferrite ring is completely contained in the region of the plane defined by the two half lines D1 and D2. It seems that in this configuration the field lines of the magnet are strongly perturbed by the presence of the ring 10, in particular in the region located under the ring which corresponds to the region in which the means of deflecting the election beams coming from the electron gun act. To obtain the same effect on the said beams, for example correcting the image geometry, the presence of the ferrite ring 10 involves using higher power magnets, which has the effect of introducing magnetic field perturbations to the front of the deflection yoke and moreover, involves an excess manufacturing cost.

Figure 4:
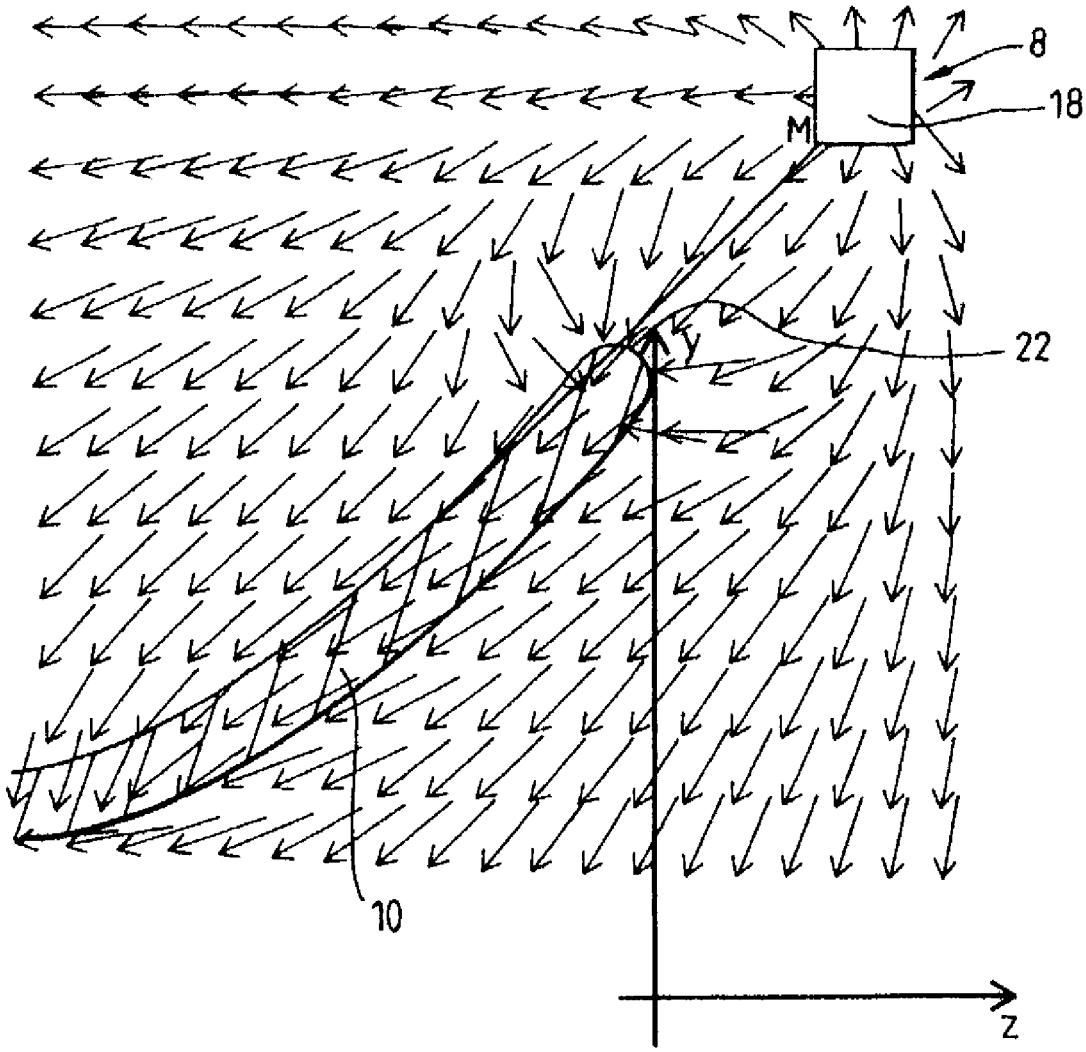
FIG. 4 shows the magnetic field lines created by a permanent magnet placed to the front of a deflection yoke in the configuration according to the invention and in a plane perpendicular to the said magnet.
Figure 5:
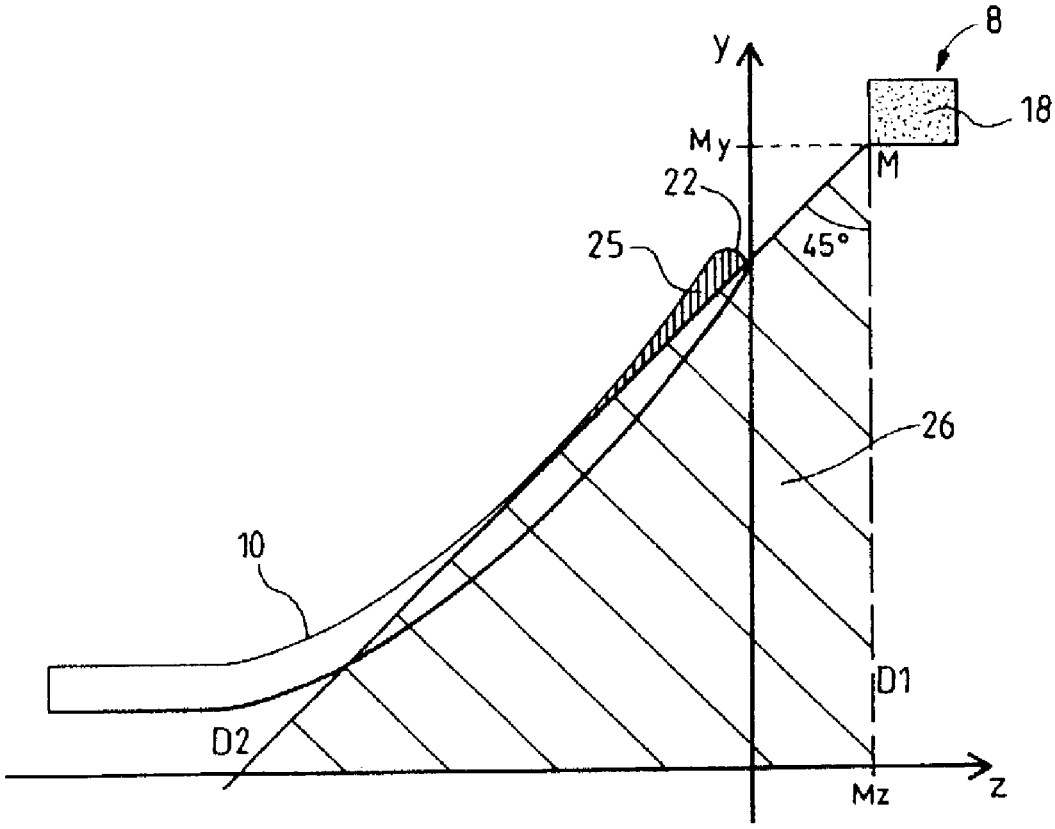
FIG. 5 is an example shown in section, of a deflection yoke equipped with correction magnets arrange according to the invention.

In the embodiment of the invention shown by FIGS. 4 and 5, the magnet 8 has a parallelepipedal cross section 18; the point M, in the YZ plane of symmetry of the magnet, shows the point of the cross section of the said magnet, the values of whose coordinates are the minimum values of the coordinates of the point of the cross section 18 along the Y and Z axes. Considering the half line D1 from M and perpendicular to the main axis Z, and the half line D2 also from M and making an angle of 45° with D1, the position of the ferrite ring 10 is such that part 25 of the front of this ring, situated in its most flared part, is at least partly situated outside the region 26 delimited by the half lines D1 and D2.

As shown in FIG. 4, illustrating the influence of the presence of the ring 10 on the field lines created by the magnet 8, it can be seen that in the configuration of the invention, in the region for deflecting the electron beams of the gun, a region located under the said ferrite ring, the field lines are virtually unmodified with respect to those created by the magnet 8 alone. In this way, it is possible to use a lower power magnet which is less expensive and less perturbing with respect to the deflection fields created by the horizontal and vertical deflection coils.

Moreover, it is noted that the configuration where the straight line D2 intersects the end 22 of the ring 10, that is to say a configuration where the magnet 8 and the flared front part of the ring 10 are in an alignment of about 45° with respect to the perpendicular to the longitudinal axis Z, corresponds to the optimum configurations in terms of a compromise between the positive effects sought for correcting the image geometry and the perturbing effect on the horizontal and vertical deflection fields.

The magnet 8 may equally have a round, square or rectangular cross section.

Within the scope of the invention, the magnet 8 may be placed either at 6H and 12H, as illustrated in FIG. 6, this in order to correct, in particular, the north/south geometrical defects or else placed at 3H and 9H in order to correct the east/west geometrical defects.

Figure 7:
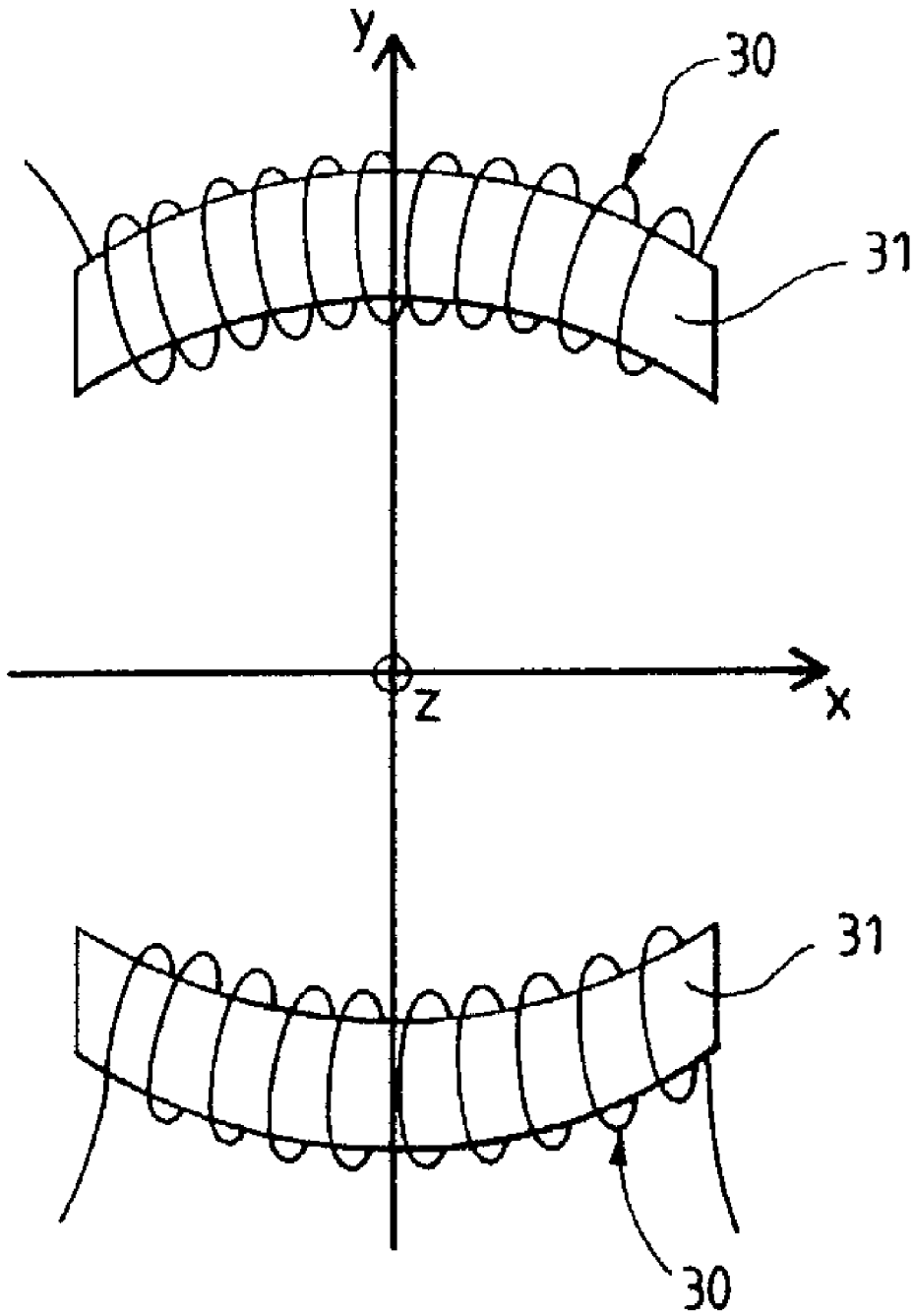
FIG. 7 illustrates an alternative embodiment of the invention in which the correction means are coils arranged around a core

In another embodiment illustrated in FIG. 7, the magnetic correction means are coils 30 comprising a core 31 lying substantially in the plane perpendicular to the longitudinal axis Z of the deflection system, the said coils being placed either at 6H–12H or at 3H–9H; if the correction mode is static, the current flowing in the coils 30 is a constant current creating a static correction field; in the case where the correction mode would be dynamic, the correction current is variable and may, for example, be proportional to the horizontal or vertical deflection current.

In the embodiments illustrated, the ring 10 is of frustoconical shape with a substantially circular front region 22, which makes the said ring axisymmetryc, making the manufacture easier and the cost of manufacture lower. However, this structure is not limiting, it being possible for the shape of the flared front part to be square or elliptical, for example, in order to be better matched to the flared shape of the rear envelope of the tube in order to minimize the deflection energies.

What is claimed is:

1. Deflection yoke for a cathode-ray tube comprising a pair of horizontal deflection coils and a pair of vertical deflection coils, the two pairs being isolated one from the other by a separator, a ferrite ring at least partly covering the deflection coils and having a flared front part, the deflection yoke comprising, in its front region, at least one pair of magnetic correction means to modify locally the magnetic field created in the said front region by the deflection coils, wherein the magnetic means are arranged in the space such that, for a plane containing the longitudinal axis of the deflection yoke and the axis of symmetry of a magnetic means, and for the point M of the plane corresponding to the point the values of whose coordinates $M_y$ and $M_z$ along the Y and Z axes are the minimum values of the coordinates along these same axes of the points of intersection of the said means with the plane, the intersection of the ring with the plane is at least partly in its front part, located outside the region delimited by a first half line passing through M and perpendicular to Z, and a second half line passing through M and making an angle of 45 ° with the first half line.

2. Deflection yoke according to claim 1, wherein the magnetic means of the pair of magnetic correction means are coils wound on a core.

3. Deflection yoke according to claim 1, wherein the magnetic means of the pair of magnetic correction means are permanent magnets.

4. Deflection yoke according to claim 3, wherein the second half line intersects the front part of the ferrite ring.

5. Deflection yoke according to claim 1, wherein the magnetic means are placed perpendicular to the Z axis along the Y axis.

6. Deflection yoke according to claim 1, wherein the shape of the ferrite ring is symmetric.

7. Cathode-ray tube comprising a deflection yoke according to claim 1.

* * * * *

UNITED STATES PATENT AND TRADEMARK OFFICE

CERTIFICATE OF CORRECTION

PATENT NO. : 7,005,788 B2
APPLICATION NO. : 10/397755
DATED : February 28, 2006
INVENTOR(S) : Nacerdine Azzi, Celine Cossu and Sebastien Volatier It is certified that error appears in the above-identified patent and that said Letters Patent is hereby corrected as shown below:

On the Title Page (item 56)
Under REFERENCES CITED omit --French Patent 0203839--.

Signed and Sealed this

Thirty-first Day of October, 2006

JON W. DUDAS
*Director of the United States Patent and Trademark Office*